US006496111B1

(12) United States Patent
Hosack

(10) Patent No.: US 6,496,111 B1
(45) Date of Patent: Dec. 17, 2002

(54) PERSONAL SECURITY SYSTEM

(76) Inventor: Ray N. Hosack, 853 Stafford Station Dr., Saginaw, TX (US) 76131

( * ) Notice: Subject to any disclaimer, the term of this patent is extended or adjusted under 35 U.S.C. 154(b) by 0 days.

(21) Appl. No.: 09/675,410

(22) Filed: Sep. 29, 2000

(51) Int. Cl.[7] ..... G08B 21/00

(52) U.S. Cl. ..... 340/540; 340/573.1; 340/425.5; 340/426; 340/539; 340/10.1

(58) Field of Search ..... 340/540, 573.1, 340/425.5, 426, 539, 10.1; 379/37, 38, 39, 40, 41, 42, 43, 44, 45, 46, 47, 48, 49, 50, 51, 52

(56) References Cited

U.S. PATENT DOCUMENTS 6,263,311 B1 * 7/2001 Dildy ..... 704/273

OTHER PUBLICATIONS

R. Schwerzel, Voice Activated Automatic Emergency Telephone Dialer and SpeakerPhone System (ID 1685), www.gtrc.gatech.edu/abstracts/1685.html.

* cited by examiner

*Primary Examiner*—Jeffery Hofsass
*Assistant Examiner*—Daniel Previl
(74) *Attorney, Agent, or Firm*—Richard K. Robinson

(57) ABSTRACT

A security system has a base unit that includes a wireless telephone transmitter and receiver and a computer unit. The computer unit has a memory for storing an emergency phone number and an outgoing message. The security system is activated by a voice command such as "fire", "help" or "police". When the voice command is detected, the computer unit will activate on audible alarm and cause the wireless telephone transmitter and receiver to connect to the location callable by the emergency phone number and to transmit the outgoing message.

12 Claims, 9 Drawing Sheets

PERSONAL SECURITY SYSTEM

BACKGROUND OF THE INVENTION

This invention relates to personal security systems and in particular, to personal security systems utilizing a wireless connection.

A security system typically installed in residential or business establishments is connected to a monitoring station via the land lines through a central switching office. The disadvantage to these systems is that a would be intruder can disable the system simply by cutting or disconnecting the land lines. Similarly, many of the residential and business security systems provide personal security through the use of a panic button or the capabilities of entering a panic code through a touch pad that is centrally located within the building being monitored. The disadvantage to this system is that an attacker can prevent the victim from reaching the panic button or the touch keypad and thus prevent a cry for help from being transmitted to the monitoring location.

SUMMARY OF THE INVENTION

A security system has a base unit that includes a wireless telephone transmitter and receiver and a computer unit. The computer unit has a memory for storing an emergency phone number and an outgoing message. The security system is activated by a voice command such as "fire", "help" or "police". When the voice command is detected, the computer unit will cause the wireless telephone transmitter and receiver to connect to the location callable by the emergency phone number and to transmit the outgoing message.

The security system includes an audible alarm operatively connected to the computer unit which turns on the audible alarm when the voice command is detected.

The security system can include a Blue Tooth transmitter operatively connected to the computer unit. The Blue Tooth transmitter transmits a warning signal to a remote unit when the voice command is recognized. The remote unit also includes a wireless telephone transmitter and receiver, a Blue Tooth receiver and a computer unit. The computer unit has a memory for storing an emergency phone number and an outgoing message and will transmit the out going message after a selected time period if the base unit fails to transmit the out going message and a cancel command has not been received.

The security system can further include an alarm located remotely from the base unit and connect thereto by the Blue Tooth network.

The security system can also be a mobile unit with GPS location capabilities.

It is an object of the invention to provide a personal security system that will allow an individual to say a predefined keyword and activate the alarm system.

It is yet another embodiment of the invention to provide a primary security system with capabilities of having one or more secondary systems to insure that in the event the primary system is detected by a would be intruder, the secondary system will continue with the notification of the authorities concerning the intrusion.

The above features and capabilities may be more apparent from a reading of the Detailed Description of the Preferred Embodiments in conjunction with the figures.

DETAILED DESCRIPTION OF THE PREFERRED EMBODIMENTS

Figure 1:
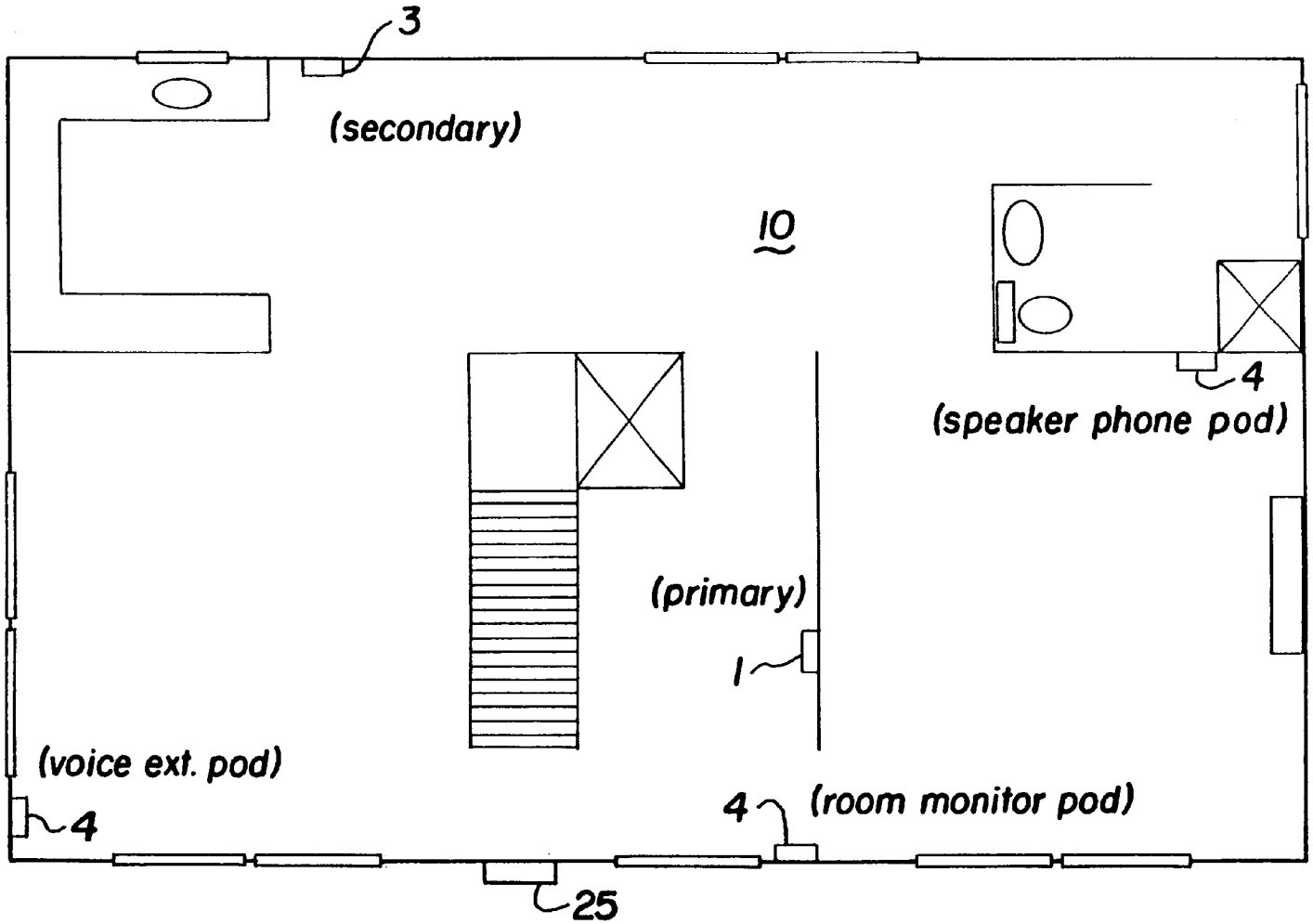
FIG. 1 is a floor plan illustrating the possible locations of the security system according to the invention.

In FIG. 1, to which reference should now be made, there is shown a floor plan of a typical building, such as a residence, which has the security system according to the invention. In FIG. 1, there is a base unit 1, which will notify the authorities in the event that it detects a predefined key word such as "help", "fire", "cops", or "police" spoken by a known speaker. The key words are selected to be words not normally heard during general conversations. Once the base unit 1 detects the key word, it will precede to dial "911" or other emergency numbers. The base unit 1 can be a modified cellular telephone having a prerecorded message stored therein.

Under current law, all cellular telephones sold in the United States will process "911" calls without the necessity of having a subscription to a cellular telephone service. Thus, the base unit 1, upon detection of a keyword, will wait a selected period of time, such as anywhere between ten (10) to twenty (20) seconds, and then dial the emergency number, i.e. 911. After connection is established, a prerecorded message is transmitted that identifies the location of the building 10 plus a statement that the occupant in that building requires assistance. As long as there is a connection, the message will continue to be played until the base unit 1 detects a "disconnect" on the line. In the event there is faulty operation of the base unit 1, a remote unit 3 will also initiate an emergency call and transmit a similar message. The faulty operation of the base unit 1 can be because it has been disconnected or that the outgoing message was interrupted without the entrance of a proper code. In any event, the secondary station 3 will transmit to the called number (i.e. "911" ) the appropriate information.

There can also be additional voice extension pods 4 located throughout the building 10 that are in communication with either the base unit 1 or the remote unit 3 through a limited broadcast system such as "Blue Tooth".

In a preferred embodiment, the short-range wireless portion includes a Blue Tooth transceiver. As is well known to those having skill in the art, Blue Tooth technology provides a universal radio interface in the 2.45 GHz frequency band that enables portable electronic devices to connect and communicate wirelessly via short-range ad hoc networks. Blue Tooth technology is described for example in Haartsen, "Bluetooth—The Universal Radio Interface for Ad Hoc, Wireless Connectivity", Ericsson Review No. 3, 1998, pp. 110–117, the disclosure of which is hereby incorporated herein by reference. This type of protocol may be used for individuals in a residential or within a conventional passenger vehicle, as well as taxi service, limousine service, and including bus and other multi-unit enclosures.

In the event there is an alarm condition, then a remote alarm pad 25 can also be sounded.

Figure 2:
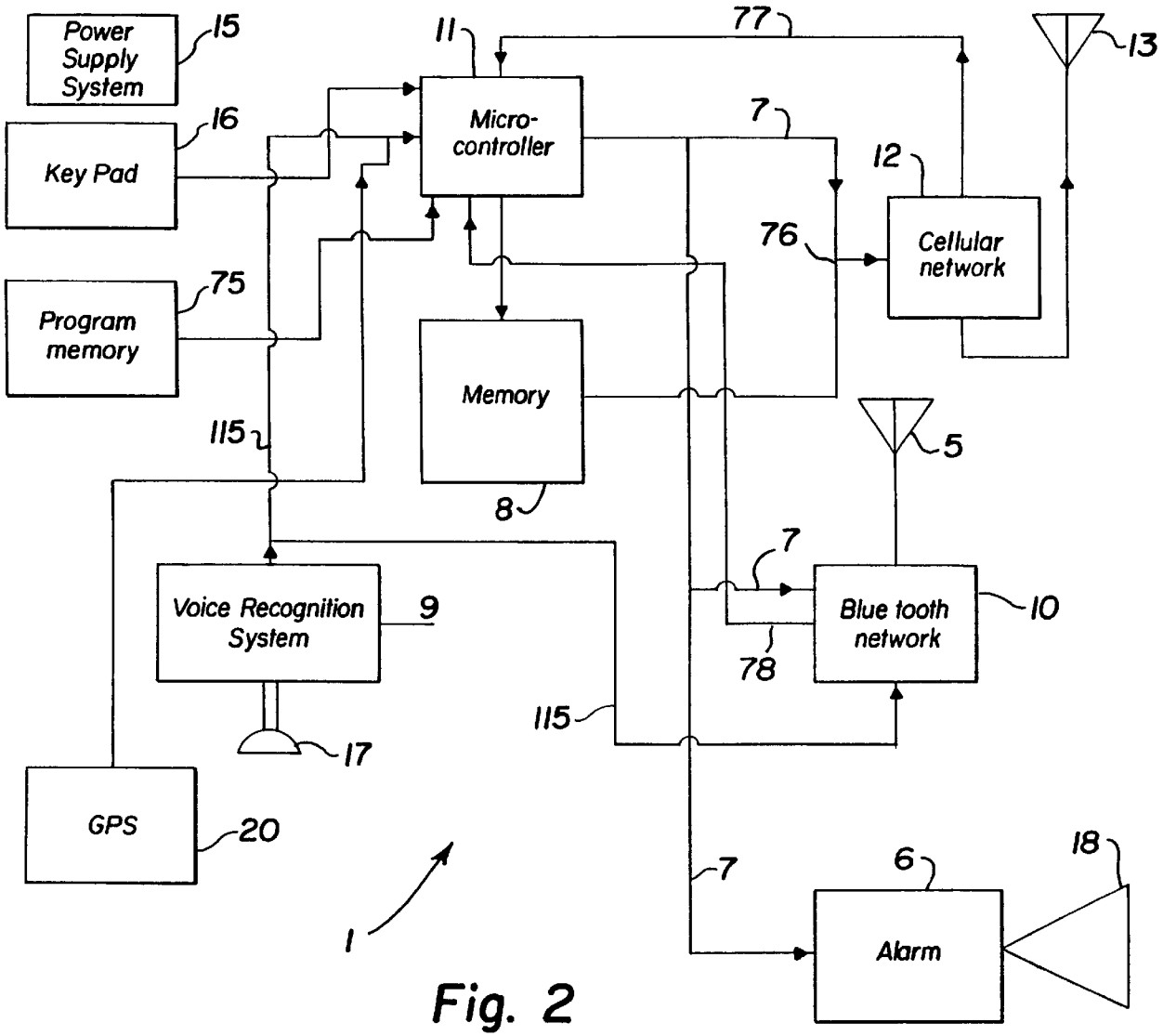
FIG. 2 is a block diagram of the base unit according to the invention.

In FIG. 2, to which reference should now be made, there is shown a block diagram of the base unit 1 or remote unit 3. Each unit includes a cellular telephone network 12 that is connected to an antenna 13. The cellular network 12 is essentially a cellular telephone that is connected to micro-controller 11 via connectors 7 and 77. The micro-controller 11 operates under the control of a program stored in a program memory 75. The micro-controller 11 controls the operations of a memory 8 which can be a device such as an IDS MICROTAD or an ISD 4004 single chip voice record/playback device. Both devices are available from Winbond Electronics Corporation America of San Jose, Calif. The memory 8 has stored therein a plurality of outgoing message including DTMF signals used to dial the emergency number or numbers. A Blue Tooth network 10 is connected to the micro-controller 11 and will transmit and receive signals via antenna 5. The Blue Tooth network 10 transmitter is connected to the micro-controller 11 by conductor 7 and will transmit alarm indications to a remote alarm pad 25. Similarly, the Blue Tooth network 10 receiver will receive inputs from a remote voice pad 4 and convey that input to the micro-controller 11 via conductor 78. There is a voice recognition system 9 and that also is capable of speaker identification, as is known in the art, such as that disclosed in U.S. Pat. No. 6,029,124 (incorporated herein by reference). The voice recognition system 9 is interfaced with a micro-controller 11 and the Blue Tooth network 10 by conductor 115.

The voice recognition system 9 is also connected to the Blue Tooth network 10 via conductor 115. A keypad 16 is provided in the event there is a desire to enter a numerical codeword to either transmit the appropriate outgoing message or, in the event of accidental activation of the base unit 1 or remote unit 3, to deactivate the base unit 1 or remote unit 3.

A power supply system 15 is a battery backup system that ensures that if electrical power is removed from the base unit 1, that a battery will still make the unit operational. Similarly, an alarm 6 is connected to the micro-controller 11 by conductor 7. The micro-controller 11 will cause a speaker 18 to sound an audible alarm throughout the building 10 when one of the codewords is detected. The alarm 6 can be a device such as the IC Horn-driver manufactured by Motorola such as MC14600. Motorola is located in Schaumburg, Ill.

Figure 3:
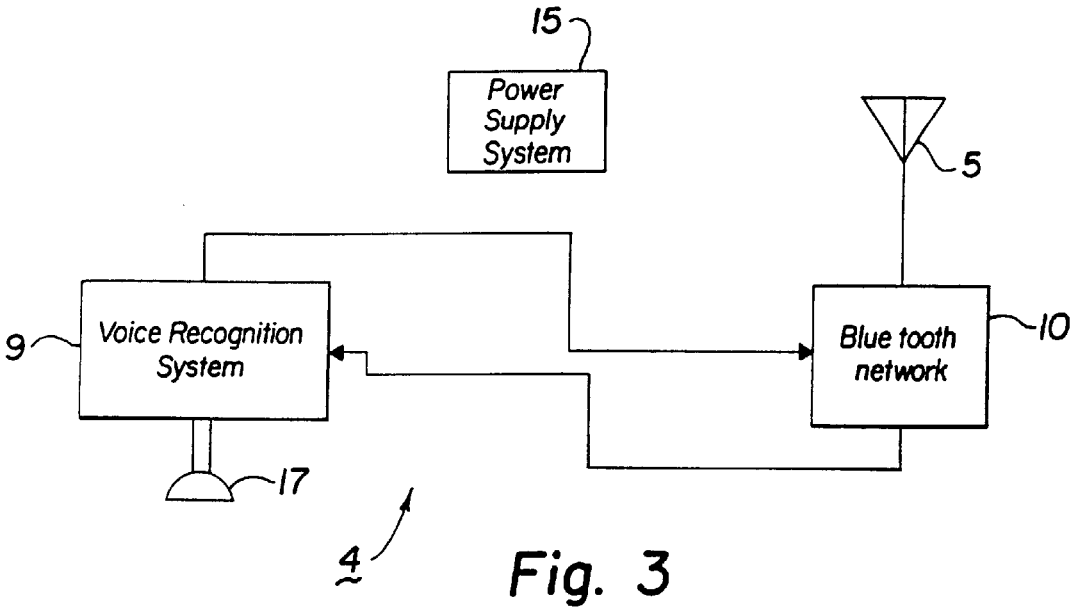
FIG. 3 is a block diagram of a voice extension pod according to the invention.

FIG. 3 is a block diagram of a voice extension pod 4 and includes a voice recognition system 9 and a Blue Tooth network 10. The Blue Tooth network 10 transmits to the micro-controller 11 the information from the voice recognition system 9 and receives a command from the micro-controller 11. One or more of the voice extension pods 4 will provide security through a residence, office building or other structures and can be ORed together with the output base unit 1 or remote unit 3 and voice recognition system 9.

Figure 4:
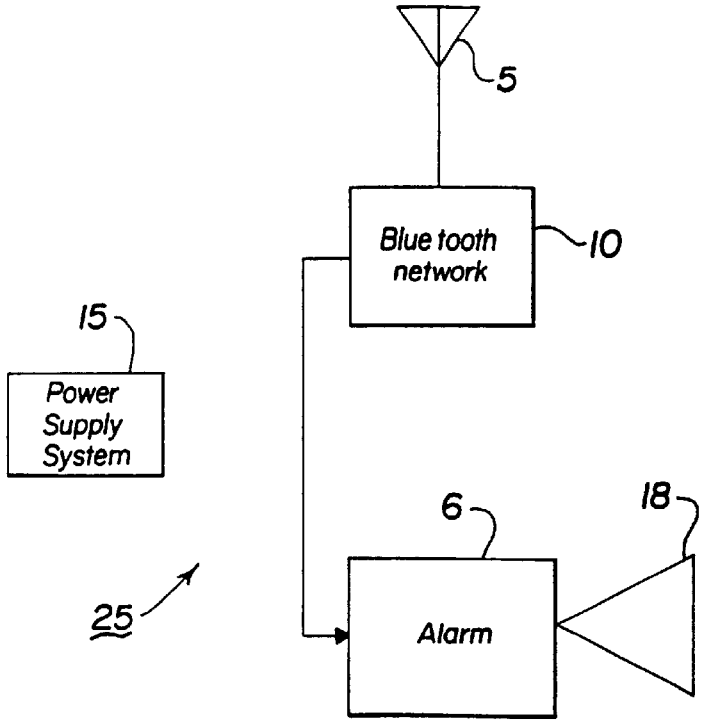
FIG. 4 is a block diagram of a remote alarm unit according to the invention.

In FIG. 4, to which reference should now be made, there is shown a block diagram of the remote alarm pad 25 of FIG. 1. The alarm unit includes an alarm driver 6 and a speaker 18. The alarm driver is activated by a reception via the Blue Tooth network 10 from the micro-controller 11 that an alarm condition has occurred. The remote alarm unit 25 can be remotely located so that an intruder can not readily disable an alarm sound emanating from the speaker 18. The Blue Tooth network 10 need only be a Blue Tooth receiver for the remote alarm pad 25.

Figure 5A:
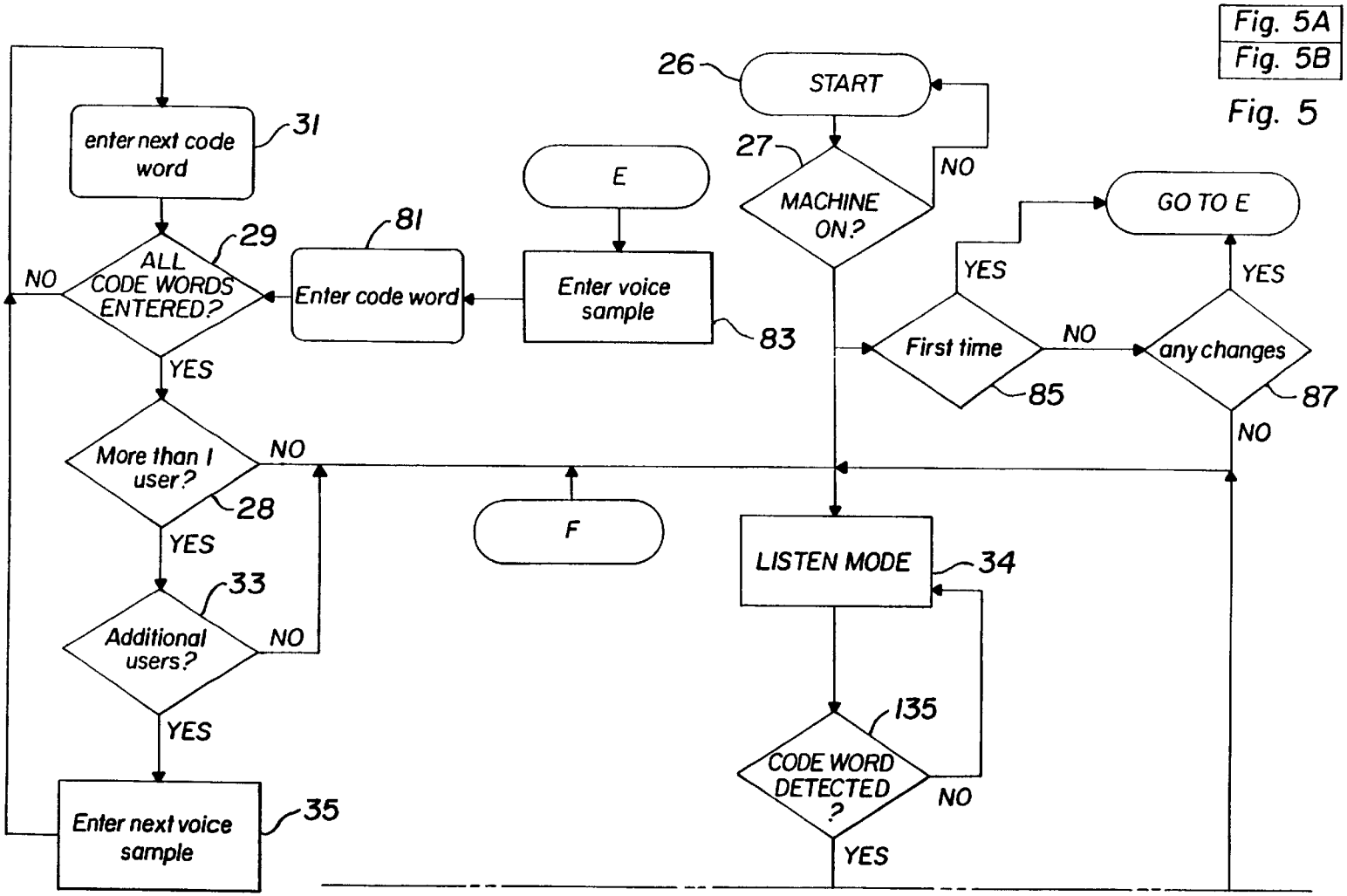
FIGS. 5 through 8 are flow diagrams of the operation of a security system according to the invention; and, FIG. 9 is a schematic diagram of the speech recognition system of FIG. 1.
Figure 5B:
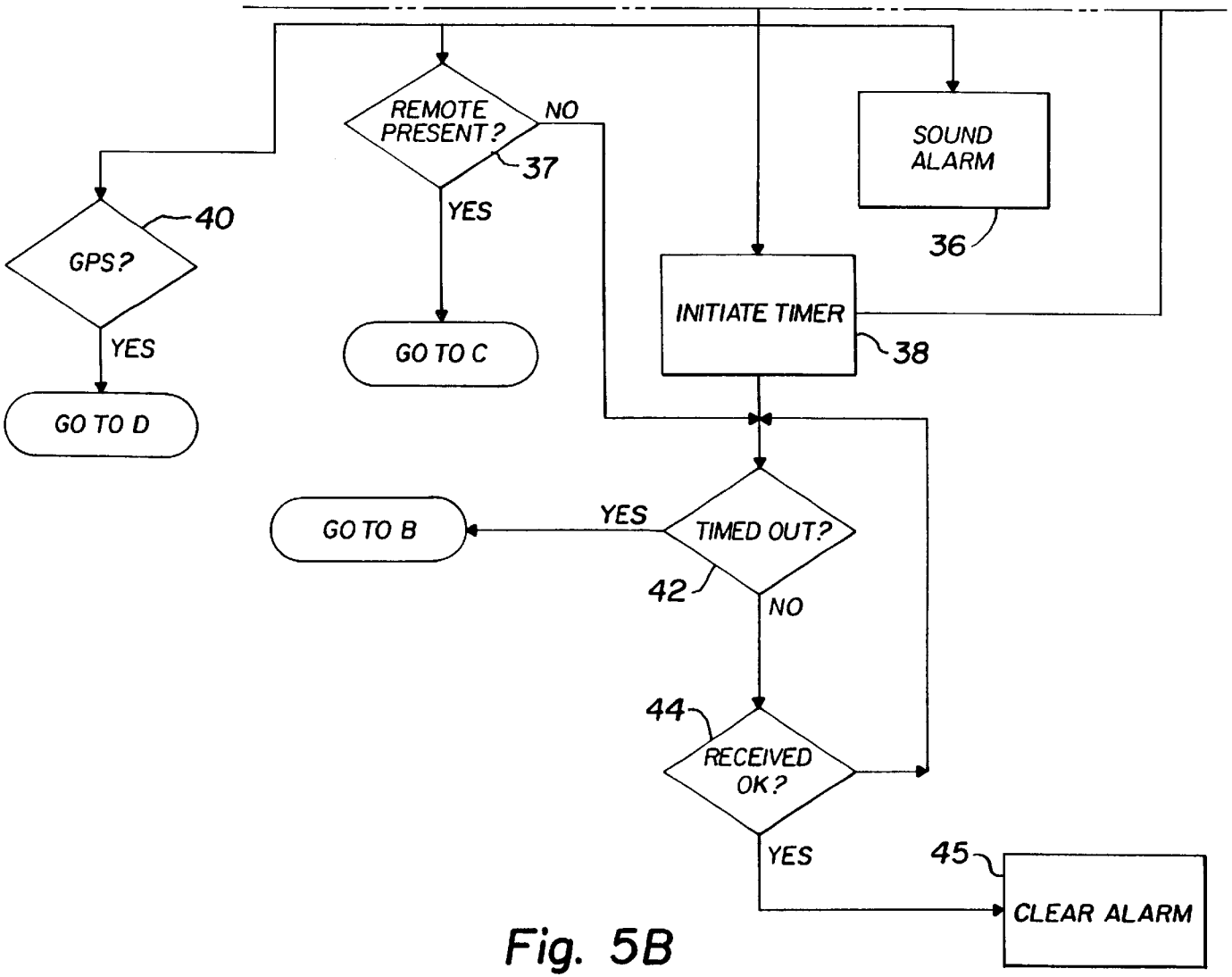

Referring to FIG. 5, there is shown a flow diagram of the program stored in the program memory 75 of FIG. 2. The program is initiated at start block 26. At decision block 27, a decision is made as to.-whether or not the machine is on. If the machine is on, a test is then made to see if this is the first time the machine has been on at decision block 85 or if there are any changes to the setup of the security system at decision block 87. A "no" decision to both of the above will cause the unit to go into the listening mode at block 34. A "yes" decision to either block 85 or 87 will cause the program to proceed to the setup mode via connector E.

Following connector E, a voice sample is taken at block 83 and a codeword is entered at block 81. A check is then made to see if all of the codewords for a particular user have been entered at decision block 29. If not, then the next codeword is entered at block 31. This process continues until all of the codewords for each user are entered.

Decision blocks 28 and 33, as well as block 35, are used to insure that only authorized users can enter the codewords or cancel an alarm condition. This is necessary to insure that an intruder does not cancel a cry for help.

After all of the codewords are entered, a check is made at decision block 28 to see if there is more than one user. If there is not more than one user, the program exits setup and proceeds to the listening mode at block 34. A check is then made at block 33 to see if there are additional users. If the answer is "no", then the program proceeds to the listening mode at block 34. If the answer is "yes", then a voice sample for the next user is entered at block 35. After block 35, the unit returns to the top of decision block 31 to start the entering of all of the codewords for each user. This process will continue until all of the users have entered all of their different codewords after which the program proceeds to the listening mode at block 34.

In the listening mode at block 34, a check is made to see if any codeword is detected at decision block 35. The program remains at block 34 and decision block 35 until, if and when, a codeword is detected. Once a codeword is detected, a timer is activated at block 38. The timer provides the user time to disable a false alarm and to prevent 911 from being dialed and the outgoing message from going out. Simultaneously with the initiation of the timer at block 38, the alarm is sounded at block 36. The sounding of the alarm includes the alarm 6 base unit 1 and any remote alarms 25.

Additionally, at this time, a check is made at decision block 37 to see if a remote is present. If a remote is present, the unit goes to connector C. If there is not a remote unit present, the program waits for the timer to time out at decision block 4. Simultaneously with the check of a remote being present, a check is made to see if GPS is present at decision block 40. If the answer is "no", then the unit returns back to the detection of the codeword. If the answer to decision block 40 is "yes there is a GPS present" then the unit proceeds to connector D.

After the timer is initiated at block 38, a check is made to see if a timer has timed out at decision block 32. If the timer has been timed out, then the unit proceeds to connector B. If the answer is "no", a check is made to see if the "okay" has been entered either through a voice command or the keypad 16 at decision block 44. If the answer is "yes", the alarm is cleared at block 45 and the unit returns to the listening mode at block 34. If the answer is "no", the base unit 1 continues to check to see if the timer has timed out.

Figure 6:
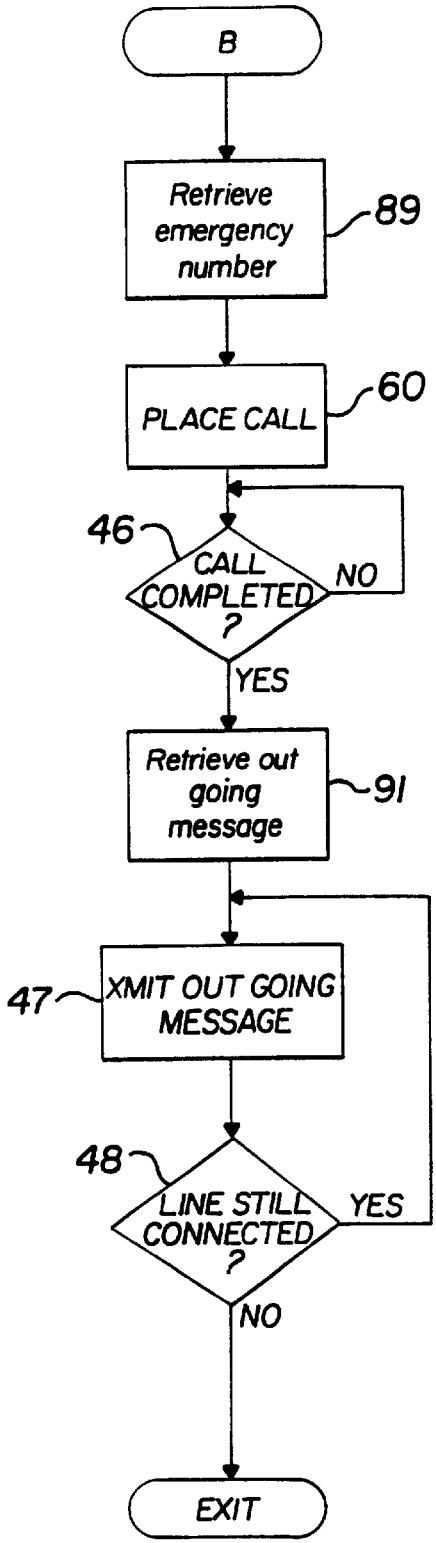

Referring to FIG. 6, following connector B, the emergency number is retrieved from the memory 8 at block 89 and the call is initiated to the emergency agency at block 60. If the call is connected at decision block 46, the program retrieves the emergency outgoing message at block 91 which is selected based on the detected codeword. For example, if the codeword was "cops", the message would request police help, if the codeword was "medic", the message would request medical assistance, and if the message was "fire", the outgoing message would ask for a fire truck to be dispatched. The outgoing message is transmitted at block 47. At decision block 48, a check is made to see if the line is still connected. If the line is still connected, the outgoing message is re-transmitted. This process will continue until the line is disconnected. When the line is disconnected, the program exits the subroutine and returns to the start position at 26 of FIG. 5.

Figure 7:
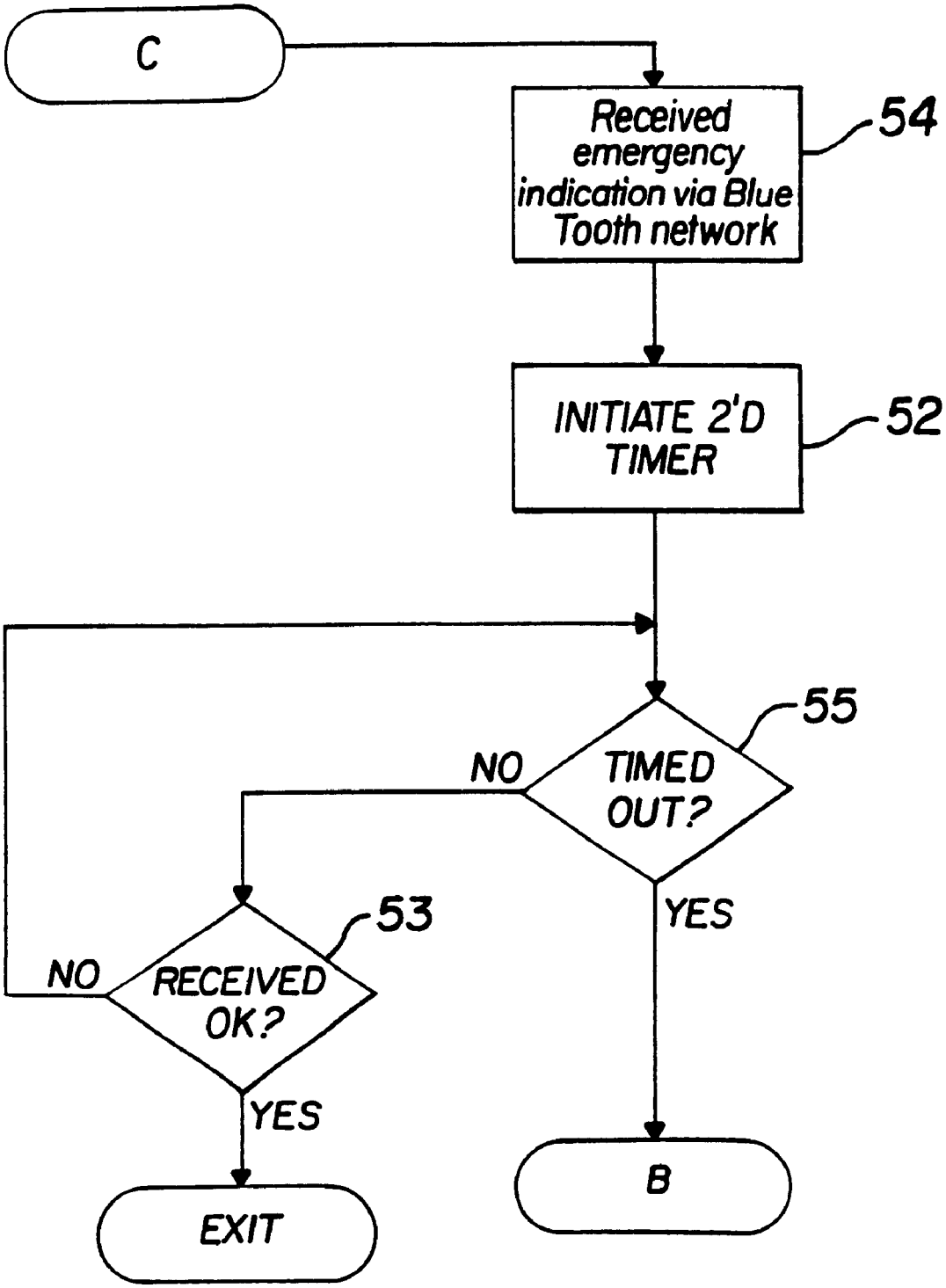

Referring to FIG. 5, a check is made to see if the remote is present at decision block 37. If the remote is present, then the program activates the remote via connector C and at block 54 of FIG. 7. In the preferred embodiment, the remote unit 3 is similar to the base unit except for its timer, the second timer is greater than the first timer located at the base unit 1. After receiving the emergency indication via the Blue Tooth network 10 at block 54, a check is made at decision block 52 to see if the unit has timed out. If "no", a check is made at decision block 53 to see if an "okay" has been received, if "no", the unit continues to check to see if a second timer has timed out. If the timer has timed out, then the program of the remote unit executes the subroutine of FIG. 6 via connector B.

Figure 8:
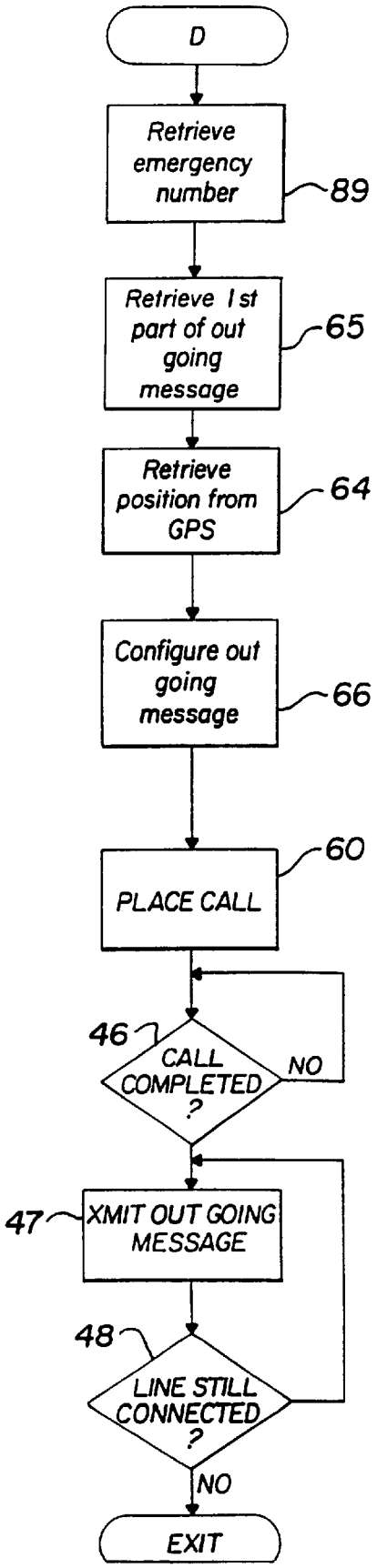

FIG. 8 is a flow diagram of when the GPS 20 is present. Following connector D, the emergency number is retrieved from the memory 8 at block 89. Then a first portion of the outgoing message is retrieved at block 64 and the second portion, the GPS location, is retrieved from the GPS 20 at block 64 and combined with the first portion at block 66. The call is initiated to the emergency agency at block 60. The call is connected at decision block 46 and the outgoing message is transmitted at block 47. At decision block 48, a check is made to see if the line is still connected. If the line is still connected, the outgoing message is re-transmitted. This process will continue until the line is disconnected. When the line is disconnected, the program exits the subroutine and returns to the start position at 26 of FIG. 5.

Figure 9:
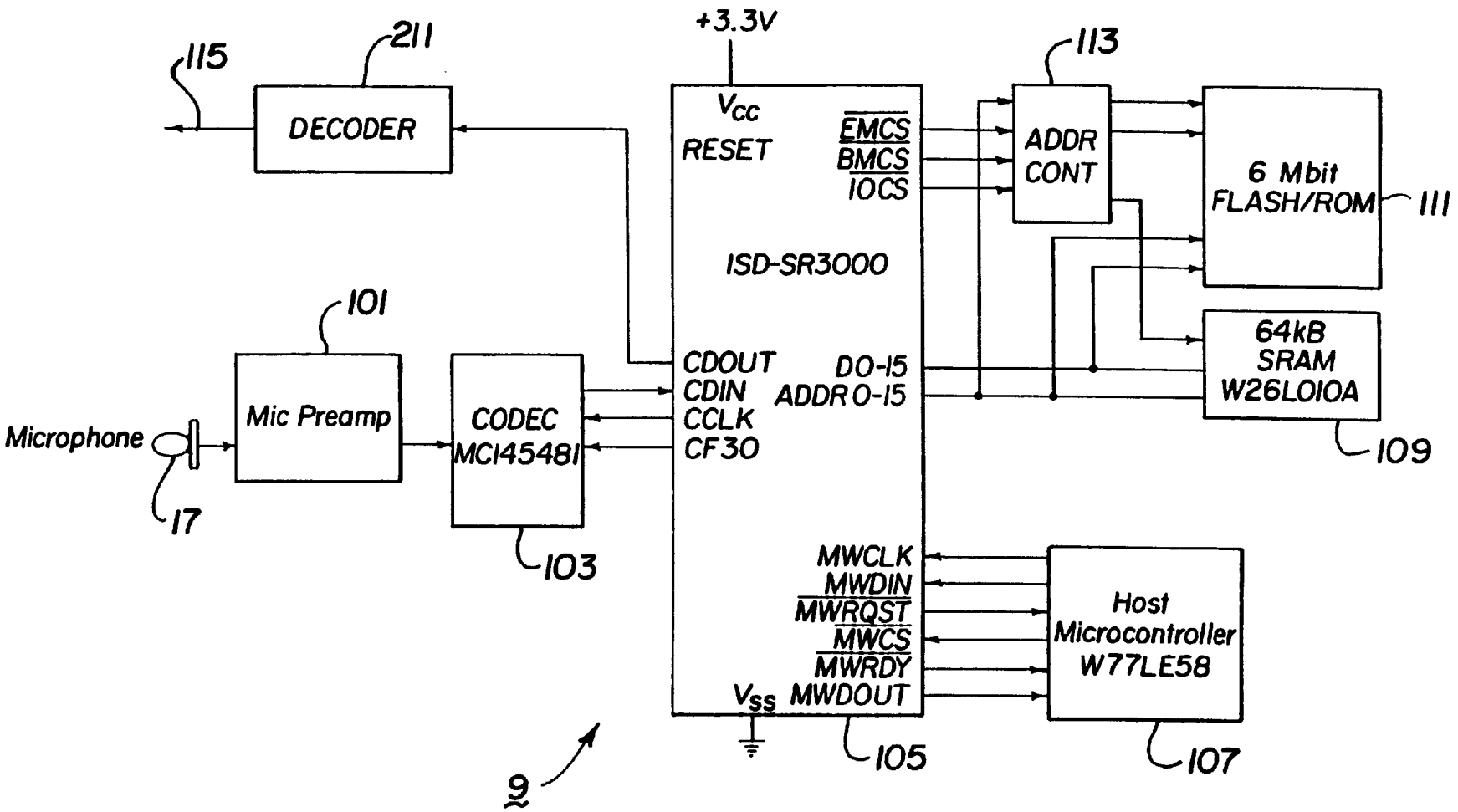

FIG. 9, to which reference should now be made, is a schematic block diagram of an embodiment of the speech recognition system utilizing an ISD-SR3000 Embedded Speech Processor 105 manufactured by Winbond Electronics Corporation America of San Jose, Calif. The speech processor 9 receives analog inputs from the microphone 17, amplifies the inputs with the preamp 101, and digitizes the analog input with codec 103. The speech processor 105 operates under the control of a micro-controller 107. An expansion memory system includes a flash memory 111 or RAM to store models etc. and the SRAM 109 is required to carry out the HMM algorithm. Addressing the memory is facilitated by the ADDR CONT device 113. The output of the speech processor 103 is either applied to a decoder 111 which decodes when one of the codewords has been detected and provides the start address of the emergency number stored in the memory 8 on conductor 115 and the start address of the outgoing message based upon the identified codeword.

Although there are many ways known to those skilled in the art for generating DTMF signals, all are applicable in this application. However, the storing of the DTMF phone number in memory 8 provides additional flexibility to the user not available using DTMF dialer circuits. For example, although 911 is or will be universal in the United States, there still may be a need to call individual phone numbers for fire, police or medical emergencies. Alternatively, there may also be a need to contact a family member. Regardless, all of the phone numbers may be retrieved and dialed simply by retrieving them according to a codeword either stored with the outgoing message or in separate locations with the memory 8.

What is claimed is:

1. A security system comprising a base unit including:

a wireless telephone transmitter;

dialer means operatively connected to the telephone transmitter for providing DTMF signals of at least a first phone number to the wireless telephone transmitter;

a voice recognition system for detecting at least a first codeword;

a message storage means for storing at least a first outgoing message, the message storage means being operatively connected to the wireless telephone transmitter to transfer the at least first out going message to the wireless telephone transmitter; and a control means being operatively connected to the message storage means, wireless transmitter, dialer means, and voice recognition system, the control means being responsive to the at least first codeword detected by the voice recognition system to enable the dialer to provide the at least first phone number to the wireless transmitter followed by the message storage means transferring the at least first out going message to the wireless telephone transmitter;

the control means further comprises; a time delay means for delaying the enabling of the dialer means for a first time period; and an audible alarm operatively connected to the control means for sounding an audible alarm upon the detection of the at least first codeword.

2. The security system according to claim 1 further comprising a local transmitter operatively connected to the control means and the voice recognition system, the control means enabling the local transmitter to transmit the detection of the at least first codeword.

3. The security system according to claim 1 further comprising: a GPS system operatively connected to the control means and wireless transmitter for providing the location of the security system as part of the at least first outgoing message.

4. A security system, comprising:

a base unit including a wireless telephone transmitter;

dialer means operatively connected to the telephone transmitter for providing DTMF signals of at least a first phone number to the wireless telephone transmitter;

a voice recognition system for detecting at least a first codeword;

a message storage means for storing at least a first outgoing message, the message storage means being operatively connected to the wireless telephone transmitter to transfer the at least first out going message to the wireless telephone transmitter;

a control means being operatively connected to the message storage means, wireless transmitter, dialer means, and voice recognition system, the control means being responsive to the at least first codeword detected by the voice recognition system to enable the dialer to provide the at least first phone number to the wireless transmitter followed by the message storage means transferring the at least first out going message to the wireless telephone transmitter; and a remote unit including:

a second wireless telephone transmitter;

a second dialer means operatively connected to the second wireless telephone transmitter for providing DTMF signals of at least the first phone number to the wireless telephone transmitter;

a second message storage means for storing at least the first outgoing message, the message storage means being operatively connected to the second wireless telephone transmitter to transfer the at least first outgoing message to the second wireless telephone transmitter; and a second control means being operatively connected to the message storage means, wireless transmitter, dialer means, and the local receiver, the second control means being responsive to the at least first codeword detected by the voice recognition system to enable the second dialer to provide the at least first phone number to the second wireless transmitter followed by the second message storage means transferring the at least first outgoing message to the second wireless telephone transmitter; and an establishable communication link between the base unit and the remote unit.

5. The security system according to claim 4 wherein the establishable communication link includes a first network operatively connected to the base unit and a second network operatively connected to the remote unit, the first network comprises: a first local transmitter operatively connected to the first control means and the first voice recognition system, the first control means enabling the first local transmitter to transmit the detection of the at least first codeword; and a remote alarm including;

a local receiver in wireless contact with the local transmitter and an audible alarm operatively connected to the local receiver for sounding an audible alarm upon the detection of the at least first codeword.

6. The security system, according to claim 4 further comprising a means for inhibiting the at least first outgoing message from being transferred to the wireless transmitter.

7. The security system according to claim 6 wherein the control means further comprises: a time delay means for delaying the enabling of the dialer means for a first time period.

8. The security system according to claim 7 wherein the second control means further comprises: a second time delay means for delaying the enabling of the second dialer means for a second time period.

9. The security system according to claim 4 further comprising: a GPS system operatively connected to the control means and wireless transmitter for providing the location of the security system as part of the at least first outgoing message.

10. A security system, comprising:

a base unit including a wireless telephone transmitter;

dialer means operatively connected to the telephone transmitter for providing DTMF signals of at least a first phone number to the wireless telephone transmitter;

a voice recognition system for detecting at least a first codeword;

a message storage means for storing at least a first outgoing message, the message storage means being operatively connected to the wireless telephone transmitter to transfer the at least first out going message to the wireless telephone transmitter;

a control means being operatively connected to the message storage means, wireless transmitter, dialer means, and voice recognition system, the control means being responsive to the at least first codeword detected by the voice recognition system to enable the dialer to provide the at least first phone number to the wireless transmitter followed by the message storage means transferring the at least first out going message to the wireless telephone transmitter; and a means for inhibiting the at least first outgoing message from being transferred to the wireless transmitter, the control means further comprises; a time delay means for delaying the enabling of the dialer means for a first time period.

11. The security system according to claim 10 wherein: the voice recognition system further comprises:

a means for detecting a second codeword that inhibits the at least first outgoing message from being transferred to the wireless transmitter.

12. The security system according to claim 10 further comprising: a GPS system operatively connected to the control means and wireless transmitter for providing the location of the security system as part of the at least first outgoing message.

* * * * *